United States Patent [19]

Mattei et al.

[11] Patent Number: 4,667,831

[45] Date of Patent: May 26, 1987

[54] DEVICE FOR FEEDING CIGARETTES TO THE WRAPPING LINE OF A PACKETING MACHINE

[75] Inventors: Riccardo Mattei; Gastone Dall'Osso, both of Bologna, Italy

[73] Assignee: G.D. Società per Azioni, Bologna, Italy

[21] Appl. No.: 710,098

[22] Filed: Mar. 11, 1985

[30] Foreign Application Priority Data

Mar. 22, 1984 [IT] Italy ..... 3391 A/84

[51] Int. Cl.[4] ..... B07C 5/34; B65B 19/30

[52] U.S. Cl. ..... 209/535; 53/54; 53/151; 131/907

[58] Field of Search ..... 209/535–537, 209/905, 911; 131/282, 907, 283; 53/151, 54, 148–150; 193/39, 40; 221/134

[56] References Cited

U.S. PATENT DOCUMENTS

| | | | |
|---|---|---|---|
| 1,993,619 | 3/1935 | Neff et al. | 53/151 X |
| 4,093,075 | 6/1978 | Molins | 209/535 |
| 4,167,091 | 9/1979 | Ruppert et al. | 53/151 X |
| 4,174,780 | 11/1979 | Farrar et al. | 209/536 |
| 4,445,520 | 5/1984 | Knight et al. | 131/907 X |
| 4,496,055 | 1/1985 | Green et al. | 209/536 |

FOREIGN PATENT DOCUMENTS

| | | |
|---|---|---|
| 1298785 | 12/1972 | United Kingdom . |
| 2023994 | 1/1980 | United Kingdom . |

*Primary Examiner*—Randolph A. Reese
*Assistant Examiner*—Edward M. Wacyra

[57] ABSTRACT

A device for feeding cigarettes to the wrapping line of a packeting machine comprises a hopper for feeding cigarettes to the machine. The hopper is divided at its lower end into outlet channels having a width substantially equal to the diameter of a cigarette, and through which the cigarettes disposed in piles descend. Along each channel there is provided, in order from the top downwards, sensor device for checking the cigarettes in succession, and at an expulsion position a device for expelling the defective cigarettes from the hopper. Along each channel there is provided cyclically operated retention mechanism for the cigarettes. This mechanism extends upstream and downstream of the expulsion position, and has two halt positions for the cigarettes. The mechanism includes two arcuate recesses in the channel which are connected via bores to a source of suction and a source of compressed air. The suction and compressed air sources are selectively connected to the recesses to either retain or expel a cigarette in the recesses.

8 Claims, 2 Drawing Figures

DEVICE FOR FEEDING CIGARETTES TO THE WRAPPING LINE OF A PACKETING MACHINE

FIELD OF THE INVENTION

This invention relates to an improved device for feeding cigarettes to the wrapping line of a packeting machine.

BACKGROUND OF THE INVENTION

In the known art, cigarettes usually enter a packeting machine by way of a hopper, to which the cigarettes are fed by suitable containers or by means of a belt conveyor in the form of a continuous layer. At the outlet of said hopper the cigarettes are combined into groups each constituted by a number of cigarettes equal to the number in a finished packet.

The characteristics of the cigarettes of each group are then checked, and those groups which comprise even only one defective cigarette are discarded.

In order to reduce the number of expelled groups of cigarettes, and thus attain considerable economical saving, a device has been proposed by the present applicant G. D. S.p.A. in U.S. Pat. No. 4,376,484, which is able to check the regularity of the cigarettes while they are still in the hopper, and to discard them before they reach the grouping station. In this device, the cigarettes are expelled from the hopper preferably by means of a pneumatic expulsion device, which directs an axial stream of compressed air against the cigarettes found to be defective, causing them to emerge through suitable apertures provided in the hopper itself.

A device of this type is however not free from drawbacks, it having been found that during their exit from the hopper the defective cigarettes frequently cause disarranging of the cigarettes lying above and below them. In this respect, the cigarettes lying above the defective cigarettes often give rise to flooding to the extent of requiring the stoppage of the packeting machine in that following the sudden exit of the immediately underlying cigarettes, they undergo a sudden uncontrolled descent during which they frequently assume an irregular arrangement.

The cigarettes lying below the discarded cigarettes also tend to become irregularly arranged during expulsion of the defective cigarettes, because of the generation of air vortices which suck them upwards in a disordered manner.

Because of these vortices, it also frequently happens that a cigarette adjacent to a defective cigarette is sucked out of the hopper, through one of the said apertures, during the described expulsion stage.

A further drawback of the described device derives from the fact that the level of the cigarettes which during each operating cycle reach the checking position and expulsion position is not rigorously constant. These level variations are caused by uncontrollable variations in the diameter of the cigarettes and also by tobacco dust or fragments which become interposed between them.

If the aforesaid events should occur, the checking device and the expulsion device exercise their action not properly in the central zones of the cigarette ends, but rather in peripheral zones thereof or even in the zones of contact between two cigarettes.

SUMMARY OF THE INVENTION

The object of the present invention is to provide an improved device of the aforesaid type in which the said drawbacks do not occur.

The said object is attained according to the present invention by an improved device for feeding cigarettes to the wrapping line of a packeting machine of the type comprising a hopper for feeding cigarettes to said machine, said hopper being divided at its lower end into and outlet channel having a width substantially equal to the diameter of a cigarette, and through which the cigarettes disposed in piles descend stepwise, and cyclic pusher means for extracting the cigarettes from the lower ends of said channels; along each of said channels there being provided, in order from upstream to downstream with reference to the cigarette descent direction, sensor means for checking the cigarettes in succession at a checking position, and, at an expulsion position, an expulsion device controlled by said sensor means in order to expel the defective cigarettes from said hopper; said device being substantially characterised by comprising cyclically operated means for retaining the cigarettes in the respective channels, to define along each of said channels at least two halt positions for the cigarettes, one disposed upstream and the other disposed downstream of said expulsion position.

The novel features which are considered as characteristic of the invention are set forth in particular in the appended claims. The device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENT

Figure 1:
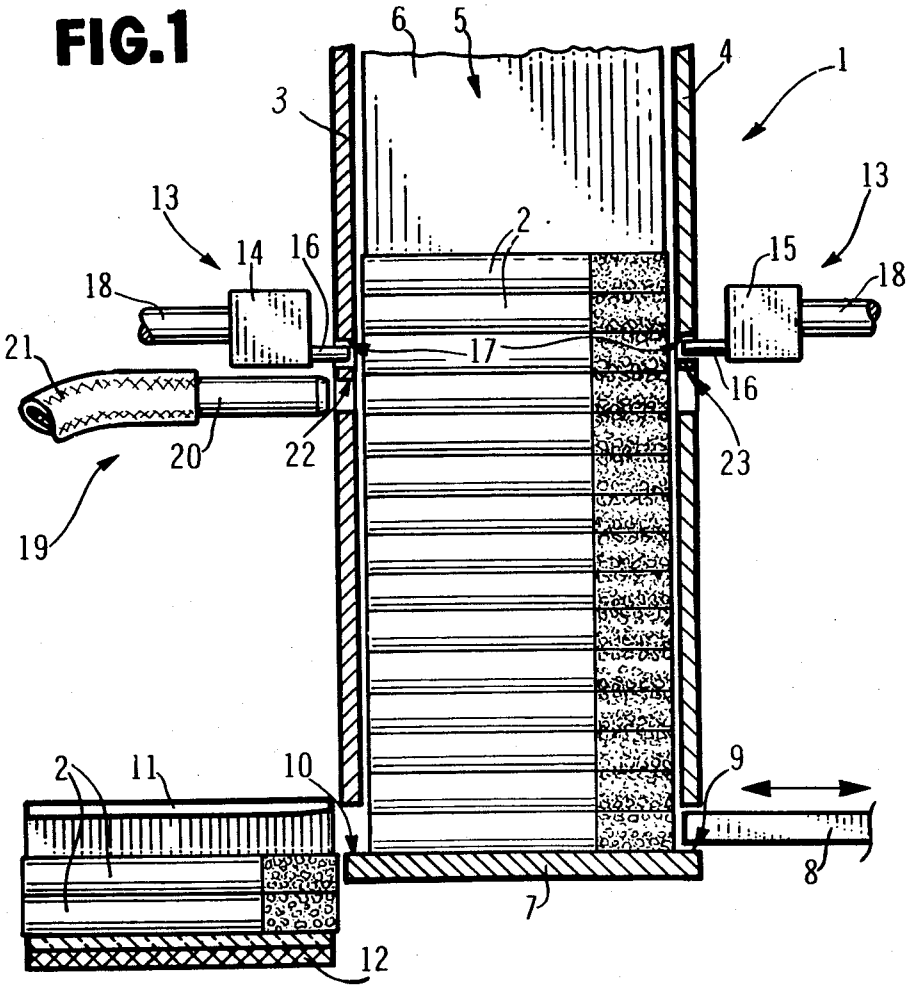
FIG. 1 is a diagrammatic side view of a cigarette feed device constructed in accordance with the present invention.

FIG. 1 shows an inlet hopper 1, for feeding cigarettes 2 to a cigarette packeting machine (not shown).

Figure 2:
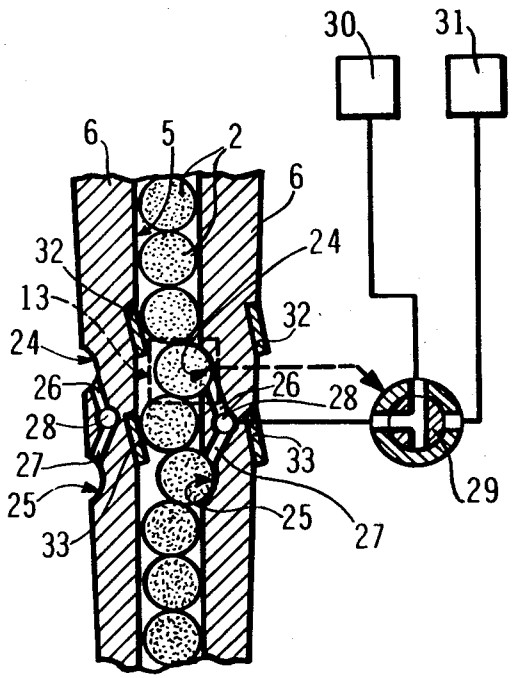
FIG. 2 is a partial front view of the device shown in FIG. 1.

The hopper 1 is defined (for an observer of FIG. 1) by a left hand wall 3 and a right hand wall 4 which are vertical and parallel, and define a compartment having a width which slightly exceeds the length of a cigarette 2. Said compartment is divided into a plurality of elementary channels 5 (of which only one is shown) by baffles 6 (two of which are visible in FIG. 2) separated by a distance which slightly exceeds the diameter of the cigarette 2.

The elementary channels 5 are delimited at the lower end by a horizontal wall 7 on which the piles of cigarettes 2 contained in the channel 5 rest. Said cigarettes 2 are engageable in groups by cyclic pusher means comprising a pusher element 8 movable in a reciprocating motion in a horizontal direction normal to the walls 3 and 4 through horizontal slots 9 and 10 provided in the walls 3 and 4. The slot 9 and 10 are adjacent to the wall 7 and have a height at least equal to the diameter of the cigarettes 2.

During each of its operating cycles, the pusher element 8 moves from a rest position external to the hopper 1 (see FIG. 1) to a position within the hopper 1, in order to push the cigarettes 2 from the channels 5 into containers 11 (of which only one is shown) carried by a conveyor belt 12 which is driven with intermittent motion and transfers the groups of cigarettes 2 towards a packeting unit (not shown). During its return stroke towards the position of FIG. 1, the pusher element 8 withdraws from the base of the hopper 1 to enable the pile of cigarettes 2 of each channel to descend by a distance equal to the diameter of a cigarette, until it makes contact with the horizontal wall 7.

During the transfer of the groups of cigarettes 2 by the conveyor belt 12, an expulsion device (not shown) expels those groups of cigarettes containing one or more defective cigarettes from the container 11.

For a better understanding of the structure of the hopper 1, the channels 5, the pusher element 8, the conveyor belt 12 and the said expulsion device (not shown), reference should be made to the description and drawings of British Pat. No. 1,298,785 and of British Pat. No. 2,023,994 in the name of the present appliacnt G. D. SpA.

At a checking position along each channel 5, there is provided a sensor means or device for checking the soundness of the individual cigarettes 2, indicated overall by 13 and comprising two opposing sensors 14 and 15, on each of which a feeler pin 16 is elastically mounted. The feeler pins 16 are aligned with each other and with respective holes 17 provided in the walls 3 and 4 of the hopper 1. The pins 16 move synchronously one towards the other under the control of reciprocating drive means 18 operating at the frequency of the pusher 8. The pins 16 check the ends of the cigarettes 2 as they pass into the checking position.

An expulsion device 19 is provided below the checking device 13 external to the hopper 1 in front of the wall 3. The device 19 is spaced from the pins 16 by a distance equal to the diameter of a cigarette 2, and is constituted by a nozzle 20 connected by a conduit 21 to a source of compressed air, not shown. Said nozzle 20 is able to direct a substantially horizontal stream of air into the channel 5 through a hole 22 in the wall 3. An outlet hole or aperture 23 for the discarded cigarettes 2 is provided in the wall 4 of the hopper 1, in alignment with the hole 22.

The checking device 13 is connected to a normally open contact (not shown) which closes should the feeler pins 16 detect a cigaratte 2 which is too short or is not sufficiently full of tobacco at its end. This contact is able, by way of a memory element (not shown), to activate the expulsion device 19 in order to expel the defective cigarettes 2 during their pause in alignment with the holes 22 and 23.

For a better understanding of the checking device 13 and expulsion device 19, reference should be made to the description of the said U.S. Pat. No. 4,376,484.

On the right hand wall (for an observer of FIG. 2) of each channel 5 there is provided two seats or grooves extending parallel to the axes of the cigarettes 2 and indicated by 24 in the case of the upper one and 25 in the case of the lower one. The groove 24 is located in a position corresponding with the feeler pins 16, whereas the groove 25 is disposed immediately below the expulsion device 19.

The two grooves 24 and 25 communicate with a conduit 28 by way of respective bores or conduits 26 and 27 provided in the baffle 6. All the conduits 28 relative to the baffles 6 of the hopper 1 are connected to a suction source 30 and to a compressed air source 31 by way of a valve means comprising a common distribution valve 29.

The grooves 24 and 25, the conduits 26, 27 and 28, the valve 29, the suction source 30 and the compressed air source 31 together constitute means for retaining the cigarettes 2 inside each channel 5.

The valve 29 is governed by the cyclic control means for the pusher 8, as described hereinafter.

On the left hand wall (for an observer of FIG. 2) of each channel 5 there are provided two guide elements or means 32 and 33, their purpose being to direct the cigarettes 2 towards the grooves 24 and 25. Said guide elements 32 and 33 are constituted by plates parallel to the axes of the cigarettes 2 and have their lower edges projecting into the channel 5.

In operation, during the pause stage of each machine cycle, and thus while the piles of cigarettes 2 are at rest inside the channel 5, each pair of opposing pins 16 probes a respective cigarette 2 through a hole 17.

During this operational stage of the device, the conduit 28 is put into communication with the suction source 30 by way of the valve 29. In this manner, the checked cigarette 2 and the cigarette 2 immediately below the expulsion device 19 are retained inside the grooves 24 and 25 respectively.

On termination of the checking stage, the valve 29 interrupts communication between the conduit 28 and the suction source 30, and following the extraction of cigarettes 2 from the base of the hopper 1 by the pusher element 8, the piles of cigarettes 2 are free to descend through one step inside the respective channels 5.

During the course of this descent, the conduit 28 is connected by the valve 29 to the compressed air source 31, which is able to produce two air streams through the bores 26 and 27 to expel any tobacco dust or fragments without hindering the descent of the cigarettes 2.

During the final stage of the descent, the valve 29 again connects the conduits 28 to the suction source 30 in such a manner that two cigarettes 2, directed by the respective guide elements 32 and 33, become inserted into two respective grooves 24 and 25.

The two cigarettes 2 are retained in said grooves 24 and 25 during the subsequent checking operation and during the possible expulsion of the cigarette 2 lying between them.

From the aforegoing description it is apparent that when connected to the suction source 30, the grooves 24 and 25 ensure perfect positioning of the cigarettes 2 subjected to the checking and expulsion operation.

Moreover, the cigarette 2 retained inside the groove 24 supports the weight of the overlying pile of cigarettes 2, so as to facilitate the possible expulsion of the underlying cigarette 2.

A further advantage of the device according to the present invention is the fact that the two cigarettes adjacent to the expulsion position are in no way influenced by the action of the device 19, as they are retained in the respective grooves 24 and 25 during the discarding of the defective cigarettes 2.

Finally it should be noted that one or more grooves analogous to the groove 24 can be provided above the sensor means 13 in order to support the overlying cigarettes 2 in a more effective manner.

The invention is not limited to the precise constructional features described above or illustrated in the drawings.

We claim:

1. A device for feeding cigarettes to the wrapping line of a packeting machine of the type comprising a hopper for feeding cigarettes to said machine, said hopper being divided into outlet channels at its lower end having a width substantially equal to the diameter of a cigarette and through which the cigarettes disposed in piles descend stepwise, and cyclic pusher means for extracting the cigarettes from the lower ends of said channels; along each of said channels there being provided, in order from upstream to downstream with reference to the descent direction of the cigarettes, sensor means for checking the cigarettes in succession at a checking position, and at an expulsion position, an expulsion device controlled by said sensor means in order to expel the defective cigarettes from said channel; the improvement residing in that said device comprises cyclically operated means for retaining the cigarettes in the respective channels at at least two halt positions for the cigarettes, at least one disposed upstream and at least another disposed downstream of said expulsion position, the means for retaining comprising a recess at each of the at least one upstream positions, conduits between the recesses and a source of suction and a source of compressed air, means for selectively supplying the recesses with compressed air or suction, and means for guiding cigarettes into the recesses.

2. An improved device as claimed in claim 1, wherein said means for selectively supplying compressed air or suction comprise valve means which operate cyclically at the frequency of said pusher means to connect said suction source to said conduits which each open into said recesses.

3. An improved device as claimed in claim 2, wherein a recess for receiving a cigarette is provided along each of said channels in a position corresponding with each of said at least two halt positions.

4. An improved device as claimed in claim 3, wherein said checking position coincides with one of said at least two halt positions.

5. An improved device as claimed in claim 1, wherein said two at least two halt positions for the cigarettes are provided adjacent to said expulsion position.

6. A device for feeding cigarettes to the wrapping line of a packeting machine comprising: a hopper feeding cigarettes to the machine, the hopper being divided into channels having a width substantially equal to the diameter of a cigarette and through which cigarettes disposed in piles descend; pusher means for expelling cigarettes at the lower end of the channels; sensor means in each of the channels for checking the cigarettes in succession at a checking position; an expulsion device in each of the channels controlled by the sensor means to expel cigarettes which are defective from the channels at an expulsion position; and retaining means for retaining cigarettes in two halt positions located immediately upstream and downstream of the expulsion position wherein the retaining means comprise recesses in each channel at the two halt positions which receive a cigarette, a source of suction and a source of compressed air connected to the recesses, and means for selectively applying the source of suction and the source of compressed air to the recesses, a cigarette being retained in a recess when the suction source is applied, and being expelled from a recess when the compressed air source is applied.

7. A device as claimed in claim 6 further comprising valve means for cyclically operating the supply of suction or compressed air to the recesses.

8. A device as claimed in claim 7 wherein the retaining means further comprises guiding means for guiding the cigarettes into the recesses.

* * * * *